United States Patent [19]

Read

[11] Patent Number: 4,528,534

[45] Date of Patent: Jul. 9, 1985

[54] SOLENOID WITH TOLERANCE CONTROL

[75] Inventor: Reginald A. Read, LaGrange, Ill.

[73] Assignee: Regdon Corporation, Brookfield, Ill.

[21] Appl. No.: 616,007

[22] Filed: May 31, 1984

[51] Int. Cl.[3] ..... H01F 7/08

[52] U.S. Cl. ..... 335/262; 335/263

[58] Field of Search ..... 335/251, 255, 258, 261, 335/262, 263

[56] References Cited

U.S. PATENT DOCUMENTS

| | | | |
|---|---|---|---|
| 2,239,312 | 4/1941 | Berges | 335/263 |
| 2,311,431 | 2/1943 | Davis | 335/262 |
| 2,419,333 | 4/1947 | Christiansen | 335/263 |
| 2,480,057 | 8/1949 | Soreng et al. | 335/262 X |
| 3,004,195 | 10/1961 | Peras | 335/262 X |
| 3,119,954 | 1/1964 | Bachi | 335/262 |
| 3,259,811 | 7/1966 | Dunn | 335/270 |
| 3,396,354 | 8/1968 | Fisher | 335/262 X |
| 4,008,448 | 2/1977 | Muggli | 335/262 X |
| 4,114,125 | 9/1978 | Komatsu | 335/258 |
| 4,177,440 | 12/1979 | Merlette | 335/247 |
| 4,239,401 | 12/1980 | Veale | 400/144.2 |
| 4,262,271 | 4/1981 | Bowers et al. | 335/263 |

*Primary Examiner*—George Harris

*Attorney, Agent, or Firm*—Neuman, Williams, Anderson & Olson

[57] ABSTRACT

A solenoid is provided having a simplified construction which minimizes the expense of manufacture and which gives precise, uniform and reliable performance. The solenoid includes a bobbin defining an armature bore and including a collar portion of substantially less axial length than the bore. The collar portion defines a passage of reduced transverse dimension relative to the remainder of the bore. The solenoid's plunger fits closely in the collar portion of the bore and loosely in the remainder of the bore. The collar portion, thus, minimizes the "chatter" or lateral movement of the plunger and the remainder of the bore accommodates any deformations that may occur during manufacture.

20 Claims, 5 Drawing Figures

SOLENOID WITH TOLERANCE CONTROL

BACKGROUND OF THE INVENTION

1. Field of the Invention

The present invention relates to electromagnetic actuators and more particularly to solenoid devices of improved design to facilitate maintaining close tolerances between the bobbin and the plunger while avoiding binding or jamming of the plunger during operation.

2. Description of the Prior Art

Electromagnetic actuators convert electrical impulses into mechanical action and perform many functions, especially in modern remote sensing and control applications. Many of these control applications require that the mechanical action produced by the actuators conform to strict requirements and tolerances. In solenoids for producing precise mechanical action, the plunger or armature must fit closely in the well to eliminate any play or "chatter" between it and the sidewalls of the well. In many such solenoids the aramature must also move longitudinally in the well of the solenoid without rotating. It is highly desirable that these operational parameters be attainable in very small solenoid devices which can be produced at low costs and which will operate reliably, e.g., without jamming or binding.

Many prior art solenoids for producing mechanical action conforming to strict requirements and precise tolerances are intricate devices having a multiplicity of close tolerance components. Several of these solenoids have armatures with plates or other components mounted on them to eliminate rotation and "chatter" and to stop the armature at precise predetermined positions. Other solenoids use complicated housing designs, permanent magnets and other close tolerance components made of various materials to provide precise, uniform and reliable performance. Producing such prior art solenoids require accurate and expensive machines and machining techniques, processes, and the use of costly materials. In addition, the complexities of the prior art devices make them susceptible to malfunctions such as binding or jamming and breakdowns particularly in small and, hence, lightweight devices.

The solenoid of the present invention provides a mechanism having a coil or winding bobbin with a central well or opening that contains the solenoid's armature, prevents it from rotating and "chattering", and allows it to provide a precise, uniform and reliable mechanical action. It provides a construction which greatly minimizes the expense of manufacture and assembly. The solenoid of the present invention comprises a small number of components with sufficiently accurate and consistent tolerances to produce the requisite mechanical action and place the armature in proper position and alignment.

OBJECTS OF THE INVENTION

It is an object of this invention to provide an improved solenoid.

It is a further object of the present invention to provide an improved solenoid that overcomes the disadvantages and complexities of the prior art.

It is another object of this invention to provide a solenoid with a construction which minimizes the expense of manufacture and assembly and gives precise, uniform and reliable performance.

It is yet another object of this invention to provide a solenoid comprising components with sufficiently accurate and consistent tolerances to produce precise mechanical action.

It is still another object of the present invention to provide a solenoid with an armature that fits loosely in the well of the solenoid to accommodate deformations that may occur during manufacturing of the solenoid bobbin or upon applying the winding to the bobbin yet does not rotate or "chatter."

Other objects, advantages and features of the present invention will become apparent upon reading the following detailed description and appended claims, and upon reference to the accompanying drawings.

SUMMARY OF THE INVENTION

In accordance with one embodiment of this invention, a solenoid which achieves the foregoing objects includes a one-piece integrally molded bobbin defining an armature bore therein and including a collar portion of substantially less axial length than the bore. The collar portion defines a passage of reduced transverse dimension relative to the remainder of the bore. The solenoid's plunger fits closely in the passage through the collar and loosely through the remainder of the bore. The collar minimizes the lateral movement or "chatter" of the plunger in the bore. It maintains close tolerances between the bobbin and the plunger while avoiding binding or jamming of the plunger during operation. The bore, the plunger, and the collar portion of the bore corresponding noncircular cross sections with the cross section of the plunger sized for a close, non-rotating fit in the collar portion of the bore and for a loose, non-rotating fit in the remainder of the bore to give precise, uniform and reliable mechanical action while accommodating any deformation that may occur during manufacture.

A plug at one end of the bobbin's bore and an associated external device define the limits of the plunger's stroke. The plunger extends out from the bore of the bobbin to perform a mechanical action on the associated external device. In the specific embodiment described herein the plunger carries a brake plate with a pad mounted on the distal end. A spring disposed around the plunger between the plate and the bobbin forces the plate and the plunger away from the bobbin and against the associated external device to be braked.

In the operation of the solenoid, application of a voltage to the coil produces flux within the core of the bobbin which moves the plunger into the bobbin against the force of the spring to release the brake. The brake plate on the plunger engages the spring and places it in compression. Removal of the voltage from the coil causes the magnetic flux to decrease, thereby reducing the magnetic force on the plunger and permitting the spring to move the plunger in the opposite direction against the associated external device, thereby applying the brake.

BRIEF DESCRIPTION OF THE DRAWINGS

For a more complete understanding of this invention one should now refer to the embodiment illustrated in greater detail in the accompanying drawings and described below by way of an example of the invention. In the drawings.

While the invention is described in connection with a preferred embodiment, it will be understood that the invention is not limited to this embodiment.

DETAILED DESCRIPTION OF THE DRAWINGS AND A PREFERRED EMBODIMENT

Figure 1:
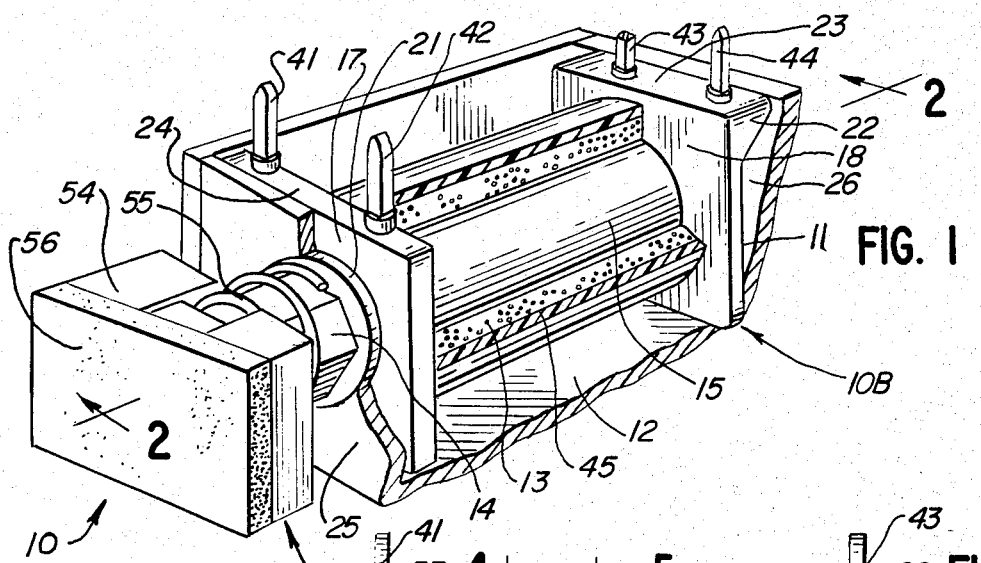
FIG. 1 is a perspective view of the preferred embodiment of a solenoid embodying the present invention.

Turning now to the drawings, FIG. 1 shows the preferred embodiment of an electromagnetic actuator or a solenoid generally at 10. The solenoid generally comprises bobbin assembly 10B and a plunger assembly 10P. The bobbin assembly includes a bobbin 11, a frame or housing 12, and a coil 13. The plunger assembly includes a plunger 14 and a brake head 54–56.

Figure 3:
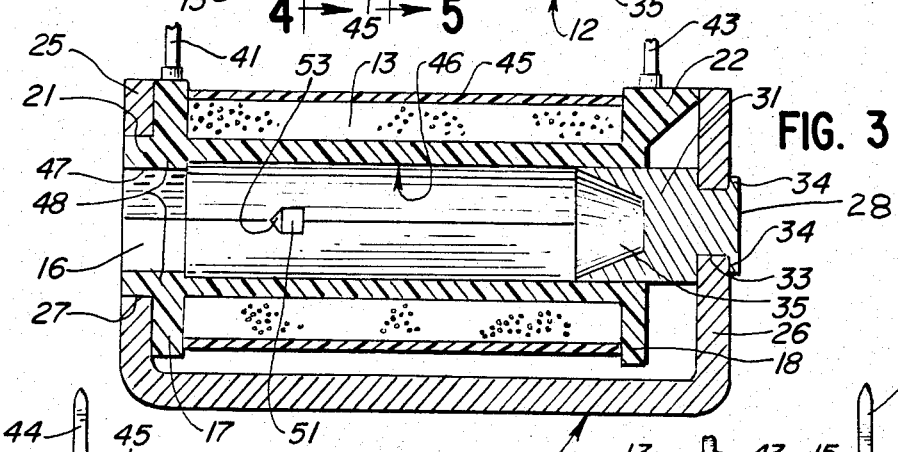
FIG. 3 is a sectional view of the bobbin assembly as in FIG. 2, i.e., without the plunger assembly.

The bobbin 11 is an integrally molded dielectric unit made of a material such as glass filled nylon. It comprises a tubular portion 15 with a cylindrical outer surface and a hexagonal inner bore or well 16 (See FIG. 3), and two end flanges 17 and 18. The flange 17 is a flat rectangular plate molded to the tubular portion 15 a short distance from one end of the tubular portion. A short length of the tube portion 15 extends beyond the flange 17 as a short sleeve portion 21. The flange 18 is also a flat rectangular plate molded to the opposite end of the tubular portion 15. It has an outwardly protruding wedge shaped lip 22 which allows easy insertion of the bobbin 11 into the housing 12. An edge surface 23 of the flange 18 and a corresponding edge surface 24 of the flange 17 serve as the mounting surfaces of the solenoid.

The box-like housing 12 receives, surrounds and protects the bobbin 11. The housing 12 has parallel opposed endwalls 25 and 26. To assemble the housing 12 and the bobbin 11, one must position the sleeve 21 of the bobbin through an opening 27 in the endwall 25 so that the flange 17 of the bobbin abuts against the endwall 25 of the housing 12 and then secure the other end of the bobbin to the endwall 26 of the housing using a plug 28 made from a material of high magnetic permeability. In this position the lip 22 of the flange 18 abuts against endwall 26 of the housing 12. The mounting surfaces 24 and 23 of flanges 17 and 18, respectively, are flush with the edges of the housing endwalls, inlcuding endwalls 25 and 26. The plug 28 includes an enlarged portion 31 having a round, hexagonal or other cross section sized to fit snugly into the bore 16 of the bobbin 11. It also includes a reduced portion 32 having a round cross section sized to fit into a round opening 33 (see FIGS. 2 and 3) in the endwall 26. The outwardly protruding end of the reduced portion 32 may be staked, as at 34, to hold the plug in place against the sidewall 26. The other end of the plug 28 is formed with a frusto-conical recess 35. This recess is in open communication with bore 16.

Terminals 41 and 42 are mounted to the flange 17 by force fitting one end of each terminal in an appropriately sized bore in the flange 17 through the edge surface 24. Terminals 43 and 44 are mounted to the flange 18 in a similar manner through the edge surface 23. The terminals 41–44 secure the bobbin 11 to a backplane or substrate (not shown) or components associated therewith. The terminals are elongate metal pins having a rectangular cross-section that perform the mechanical function of mounting the bobbin 11 to the substrate. However, two of the four terminals also serve an electrical function in that they make the appropriate electrical connection between a voltage source on the substrate and the solenoid winding by connection of the coil wire thereto. This connection may be through a wire slot (not shown) in the respective flange 17 or 18.

The bobbin 11 supports the solenoid's coil 13 which is wound around the tube 15 between the flanges 17 and 18. An additional insulative shell or wrapping 45, e.g., insulating tape, may cover the coil 13.

The bobbin 11 also receives the armature plunger 14 within bore 16. This plunger 14 is a metal rod or bar with a hexagonal cross-section corresponding in shape to the cross-section of the bore 16. The plunger may be cut from rod stock of appropriate shape and size. However, it will be appreciated that such stock vary somewhat in size, and individual pieces may be slightly bent, warped or otherwise non-uniform over their length. The bobbin is formed with a bore 16 of significantly greater cross-sectional dimension than the plunger along most of the length of the bore, to allow free axial movement of the plunger, without binding or jamming, despite such variations. This may be termed a "sloppy" fit. Thus, the plunger 14 fits loosely along enlarged portion 46 of the bore 16. However, a short bore section 47 at the entrance end defines a relatively short collar portion 48 which provides a close fit with the plunger to avoid lateral vibratory movement or "chatter." This collar portion 48 is an integral part of the bobbin 11 and provides the same thickness or dimensional reduction along all of the six sidewalls of the bore 16. The length of the reduced portion 47 (See FIGS. 2 and 3) is small compared with the length of the enlarged portion 46.

The collar portion 48 provides the close, sliding fit required to control the movement of the plunger 14, eliminate any play or "chatter" of the plunger 14 in the bore 16, and produce precise, uniform and reliable mechanical action. However, this close tolerance fit extends over only a short length thereby minimizing or avoiding binding of the parts during activation. The enlarged portion 46 accommodates any deformation that may occur during the manufacture of the solenoid bobbin 11 or upon applying the winding or coil 13 to the bobbin. The loose fit of the plunger 14 in this enlarged portion 46 allows the plunger to move longitudinally in the bore 16 freely and without interruption.

By way of a specific example, a solenoid 10 of small size and inexpensive construction was fabricated for use as a brake for discs in a small computer, with a plunger about $\frac{3}{4}$ inch long cut from rod stock 5/32 inch outside diametrical dimension as measured between opposing parallel flat surfaces. In an example, such stock was obtained to a nominal tolerance specification of $+0.000-0.002$. The plunger was of uniform cross-section over its length, except for tapering of the inner end and machining a retaining notch 52 as referred to further below. Correspondingly, the primary bore portion 46 of bobbin 11 was 0.160 inches$\pm$0.001 inch across the flats over a length of 0.688 inches between flanges 17 and 18, while the reduced portion 47 was 0.158$\pm$0.001 inch over a length of 0.090 inches.

Figure 2:
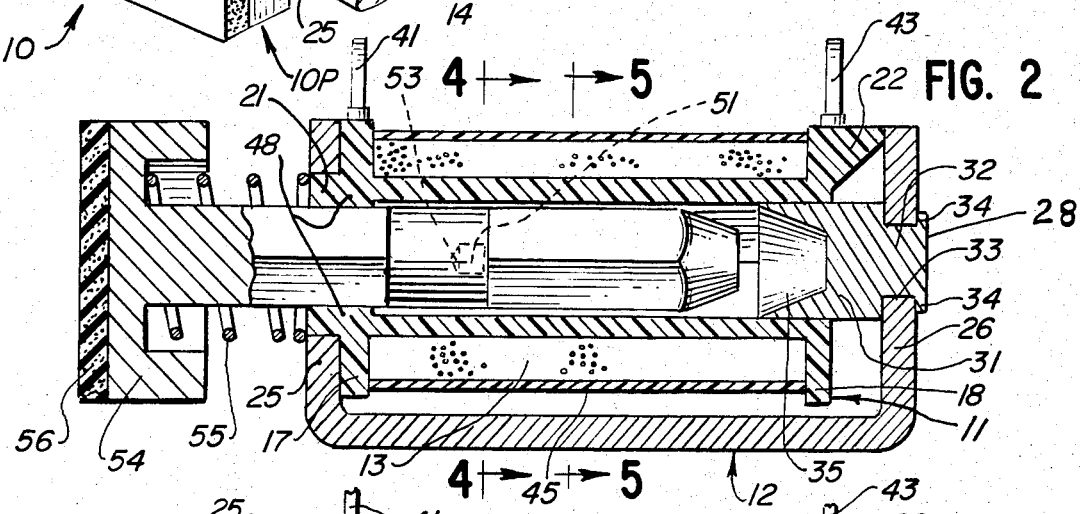
FIG. 2 is a longitudinal sectional view taken generally along a central axial plane of the solenoid, as illustrated by line 2—2 of FIG. 1.
Figure 4:
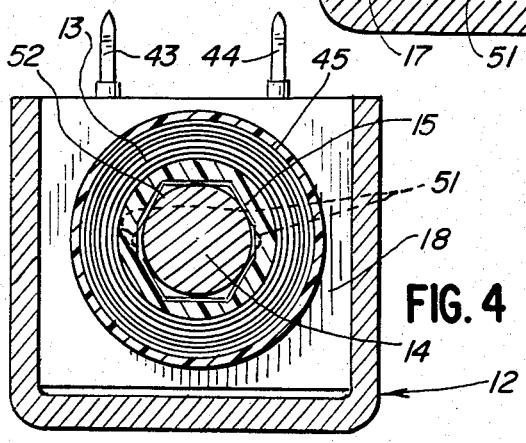
FIG. 4 is a sectional view taken along line 4—4 in FIG. 2.
Figure 5:
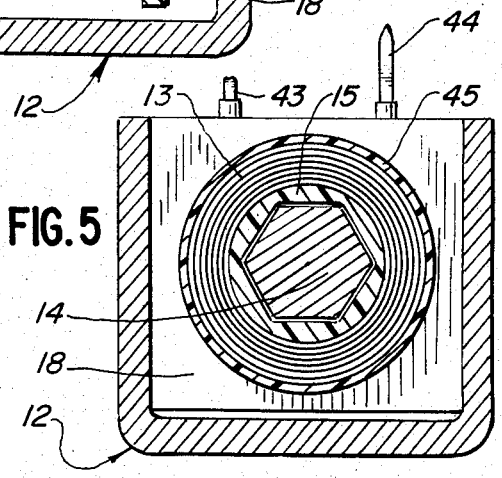
FIG. 5 is a sectional view taken along line 5—5 in FIG. 2.

Two retaining ridges 51 (FIG. 2 shows only one of the ridges) located on opposite sides of bore 16 at apexes between two flat sides and midway into the bore extend into a corresponding elongate notch 52 (See FIG. 4) in the plunger 14. The length of the notch 52 is greater than the stroke of the plunger so that the ridges 51 do not impede the plunger's movement. These two ridges 51 serve to retain the plunger 14 in the bore 16 during manufacture and shipment of the solenoid. Each one of these two ridges 51 has a sloping surface 53 to provide a caming action for ease of insertion of the plunger 14 into the bore 16 and the retaining ridges 51 into notch 52. One end of the plunger 14 carries a plate 54 mounted thereon. A spring 55 disposed around the plunger 14 between the plate 54 and the bobbin 11 pushes the plate 54 and attached plunger outward from the bobbin. The plate 54 also supports a brake pad 56. Application of a voltage to the coil 13 produces flux within the bore 16, which moves the plunger 14 inward, whereby the plate 54 compresses the spring 55. The plug 28 stops the plunger 14 to limit the plunger's inward stroke. The removal of the voltage from the coil 13 causes flux in the bore 16 to decrease, thereby reducing the retention force on the plunger 14 and permitting the spring 55 to drive the plate 54 and the plunger 14 in the opposite direction, i.e. outward. An associated external device (not shown) stops the plunger 14 to end the plunger's outward stroke.

Thus, a solenoid has been provided which meets the aforestated objects. The solenoid has a simplified construction which minimizes the expense of manufacture and assembly while providing precise, uniform and reliable performance. The plunger will move freely without "chatter" or jamming to precise, predetermined positions upon application and removal of electric power and, thereby, will reliably perform various mechanical functions.

While one preferred embodiment of the invention is illustrated, it will be understood, of course, that the invention is not limited to this embodiment. Those skilled in the art to which the invention pertains may make modifications and other embodiments employing the principles of this invention, particularly upon considering the foregoing teachings. For example, one skilled in the art may modify the solenoid of the present invention to have a plunger and an armature bore of round cross-section when rotation of the armature may be allowed. In addition, one skilled in the art may use the housing to mount the solenoid to a substrate rather than the terminals used in the specific embodiment described above. Therefore, by the appended claims, it is intended to cover any such modifications and other embodiments as incorporate those features which constitute the essential features of this invention.

What is claimed is:

1. A solenoid device comprising an integrally molded bobbin defining an armature bore therein and including a collar portion of substantially less axial length than said bore and defining a passage therethrough of reduced transverse dimension relative to the remainder of said bore; a plunger extending into said bore through said collar portion and serving as an armature of said solenoid, said plunger having a close, sliding fit engagement within said collar portion which controls the movement of said plunger and substantially eliminates lateral movement thereof, said plunger having a loose, sliding engagement in the remainder of said bore; and coil means surrounding said bobbin for generating magnetic flux to move said plunger axially in said bore; said plunger formed of material having high magnetic permeability.

2. The solenoid device of claim 1, wherein said plunger and said collar portion interact to preclude relative rotary movement between said bobbin and said plunger.

3. The solenoid device of claim 2, wherein said plunger and said bore have noncircular complementary cross-sections.

4. The solenoid device of claim 1, wherein said bobbin is a glass-filled nylon member.

5. The solenoid device of claim 1, including a plurality of terminals for mounting said solenoid device to a substrate and for electrically connecting said solenoid to a voltage source.

6. The solenoid device of claim 1 wherein said collar portion is disposed at one end of said bore.

7. The solenoid device of claim 1, 2, 3, 5, or 6 wherein said plunger is of substantially uniform outside transverse dimension throughout the portion thereof which enters said bore.

8. A solenoid device comprising an integrally molded bobbin defining an armature bore therein and including a collar portion of substantially less axial length than said bore and defining a passage therethrough of reduced transverse dimension relative to the remainder of said bore said collar portion disposed at one end of the said bore; a plunger extending into said bore through said collar portion and serving as an armature of said solenoid, said plunger having a close, sliding fit engagement within said collar portion which controls the movement of said plunger and substantially eliminates lateral movement thereof, said plunger having a loose, sliding engagement in the remainder of said bore; a plug disposed in the other end of said bore for stopping said plunger; and coil means surrounding said bobbin for generating magnetic flux to move said plunger axially in said bore; said plug and said plunger formed of material having high magnetic permeability.

9. The solenoid device of claim 8, wherein said solenoid includes a housing disposed around said bobbin.

10. The solenoid device of claim 9, wherein said solenoid includes a shell surrounding said coil means for protecting said coil means.

11. The solenoid of claim 10, wherein said solenoid includes a plurality of terminal pins for mechanically connecting said solenoid with a substrate and for electrically connecting said solenoid with a voltage source.

12. The solenoid device of claim 9, wherein said plunger and said collar portion interact to preclude relative rotary movement between said bobbin and said plunger.

13. The solenoid device of claim 12, wherein said plunger and said bore have noncircular complementary cross-sections.

14. The solenoid device of claim 9, wherein said bobbin is a glass-filled nylon member.

15. The solenoid device of claim 8, 9, 10, 11, 12, 13 or 14, wherein said plunger is of substantially uniform outside transverse dimension throughout the portion thereof which enters said bore.

16. An integrally molded solenoid bobbin for receiving an electrical coil therearound, said bobbin comprising an elongate member with a plunger bore therein and including a collar portion of substantially less axial length than said bore, said collar portion defining a passage therethrough of reduced transverse dimension relative to the remainder of said bore, whereby an armature plunger portion of predetermined cross-sectional shape and dimensions corresponding to said passage will have close finding fit engagement within said collar portion which controls the movement of said plunger portion and substantially eliminates lateral movement thereof, said plunger having loose sliding engagement in said remainder of said bore.

17. The bobbin of claim 16, wherein said bobbin is made of glass-filled nylon.

18. The bobbin of claim 16, wherein said collar portion is disposed at one end of said bore.

19. The bobbin of claim 16, wherein said plunger and said collar portion interact to preclude relative rotary movement between said bobbin and said plunger.

20. The bobbin of claim 16, wherein said plunger and said bore have noncircular complementary cross-sections.

* * * * *

UNITED STATES PATENT AND TRADEMARK OFFICE

CERTIFICATE OF CORRECTION

PATENT NO. : 4,528,534

DATED : July 9, 1985

INVENTOR(S) : Reginald A. Read

It is certified that error appears in the above-identified patent and that said Letters Patent is hereby corrected as shown below:

Column 1, line 38 "require" should read --requires--. Column 2, line 31, insert "have" before --corresponding--. Column 4, line 19, after "stock" insert --may--. Column 6, line 16, after "3," insert --4,--. Column 6, line 47 "9" should read --8--. Column 6, line 54, "9" should read --8--.

Signed and Sealed this

*Twenty-fourth* Day of *June 1986*

[SEAL]

*Attest:*

DONALD J. QUIGG

*Attesting Officer*

*Commissioner of Patents and Trademarks*